US005916071A

United States Patent [19]

Lee

[11] Patent Number: 5,916,071

[45] Date of Patent: Jun. 29, 1999

[54] SHOE EQUIPPED WITH SPRING FOR DOING JUMPING EXERCISE

[76] Inventor: Yan-Yee Lee, 16 Lane 667, Chang Shang Road, Sir Nan Village Sun Kang Hsiang, Taichung Hsien, Taiwan

[21] Appl. No.: 09/044,853

[22] Filed: Mar. 20, 1998

[51] Int. Cl.[6] ..... A63B 25/10

[52] U.S. Cl. ..... 482/77; 482/79; 482/124

[58] Field of Search ..... 482/77, 79, 121, 482/122, 124; 36/7.8, 113

[56] References Cited

U.S. PATENT DOCUMENTS

| | | | |
|---|---|---|---|
| 2,756,517 | 7/1956 | Youtz | 482/77 |
| 4,196,903 | 4/1980 | Illustrato | 272/114 |
| 4,492,374 | 1/1985 | Lekhtman et al. | 272/114 |
| 5,205,798 | 4/1993 | Lekhtman | 482/77 |

*Primary Examiner*—Jerome W. Donnelly
*Assistant Examiner*—Tam M. Nguyen
*Attorney, Agent, or Firm*—Harrison & Egbert

[57] ABSTRACT

An exercise shoe includes a shoe body and a frame fastened to the underside of an outsole of the shoe body. The frame is provided therein with a circular body in which a spring is located such that both ends of the spring are engaged with the retaining rings of two control rod members, and that the spring can be expanded or compressed by the control rod members so as to adjust the resilience of the frame. The frame is provided with a skidproof bottom to prevent the exercise shoe from skidding on a surface.

7 Claims, 6 Drawing Sheets

SHOE EQUIPPED WITH SPRING FOR DOING JUMPING EXERCISE

FIELD OF THE INVENTION

The present invention relates generally to an exercise shoe, and more particularly to an exercise shoe which is equipped with a spring for doing a jumping exercise.

BACKGROUND OF THE INVENTION

The conventional exercise devices take up a large floor space and are therefore not suitable for use in a small room. It is becoming increasingly difficult to find a gymnasium or playground, which is not overcrowded. As a result, jumping exercises have become rather popular in view of the fact that the jumping exercise can be done in a relatively small area.

SUMMARY OF THE INVENTION

The primary objective of the present invention is therefore to provide an exercise shoe for doing a jumping exercise on a small floor or ground space.

In keeping with the principle of the present invention, the foregoing objective of the present invention is attained by an exercise shoe which is equipped with a spring housed in a frame. The frame is fastened to the outsole of the exercise shoe. The frame is provided respectively at both ends thereof with an elastic protective cover. The protective cover is fastened with the frame by a control rod which is engaged with a pull rod. The pull rod has a free end which is provided with a retaining ring engageable with one end of the spring. The frame is provided with a skidproof bottom.

The foregoing objective, features and functions of the present invention will be more readily understood upon a thoughtful deliberation of the following detailed description of the embodiments of the present invention with reference to the accompanying drawings.

DETAILED DESCRIPTION OF THE EMBODIMENTS

Figure 1:
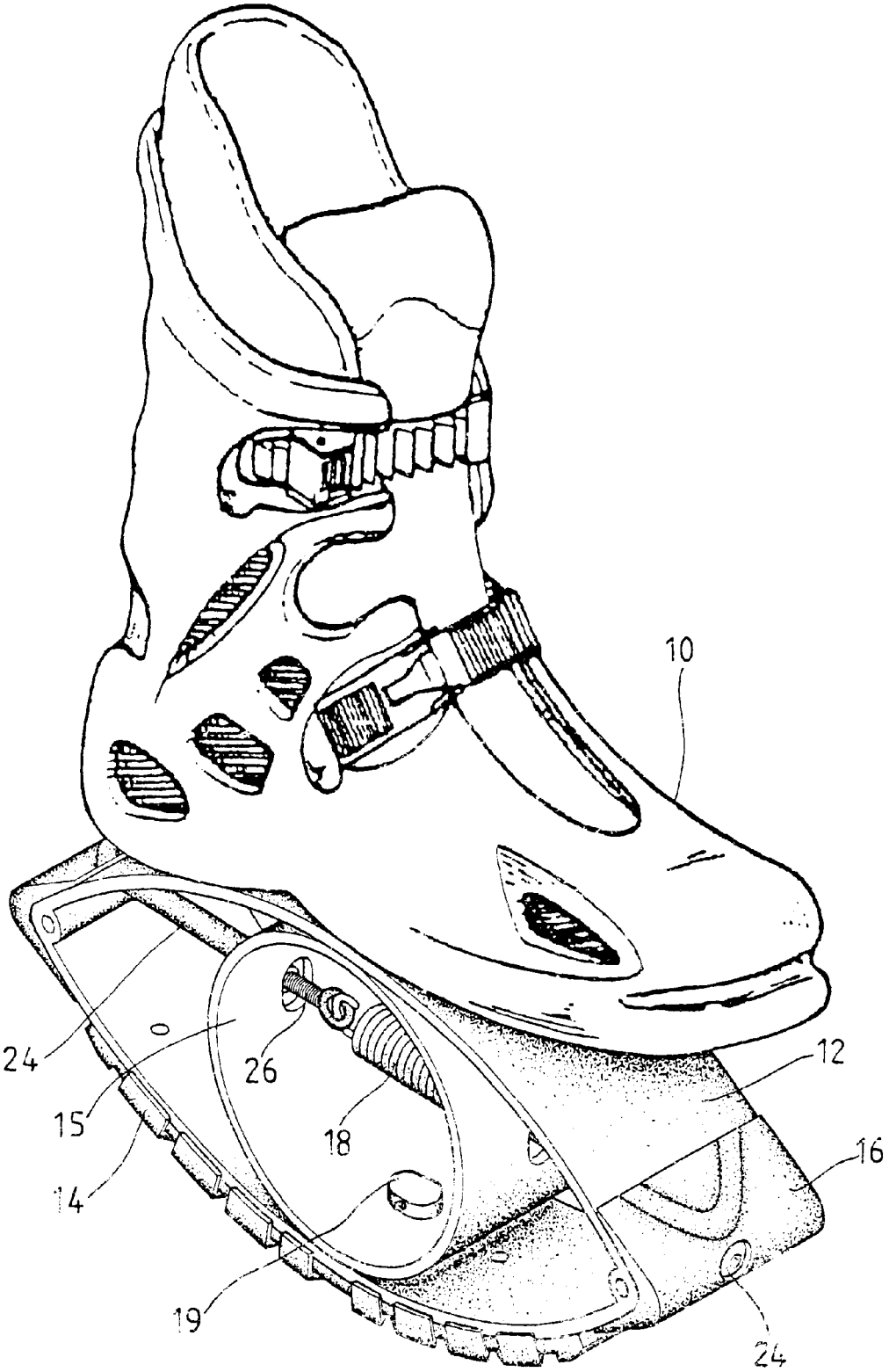
FIG. 1 shows a perspective view of the present invention.
Figure 2:
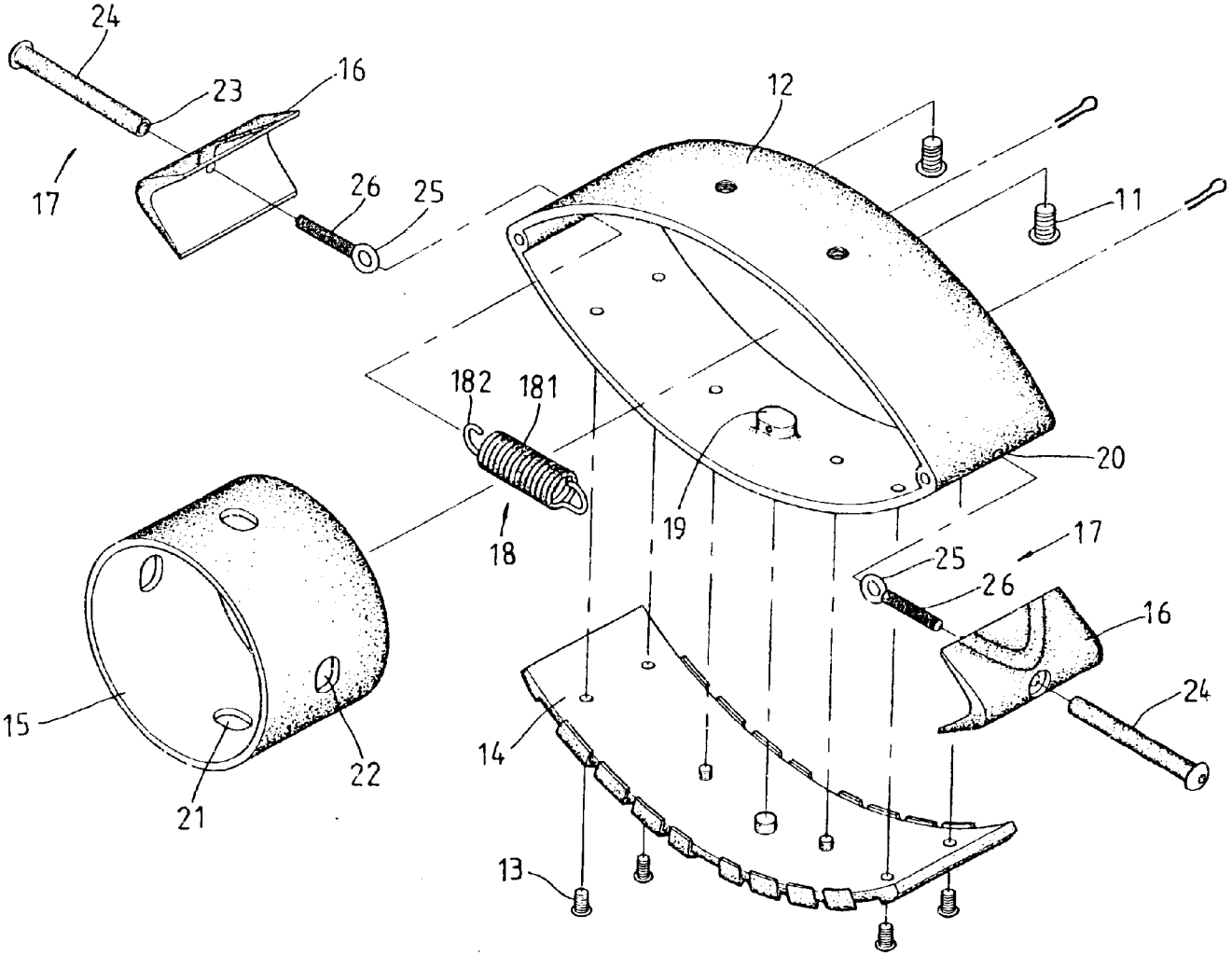
FIG. 2 shows an exploded view of the frame of the present invention.
Figure 3:
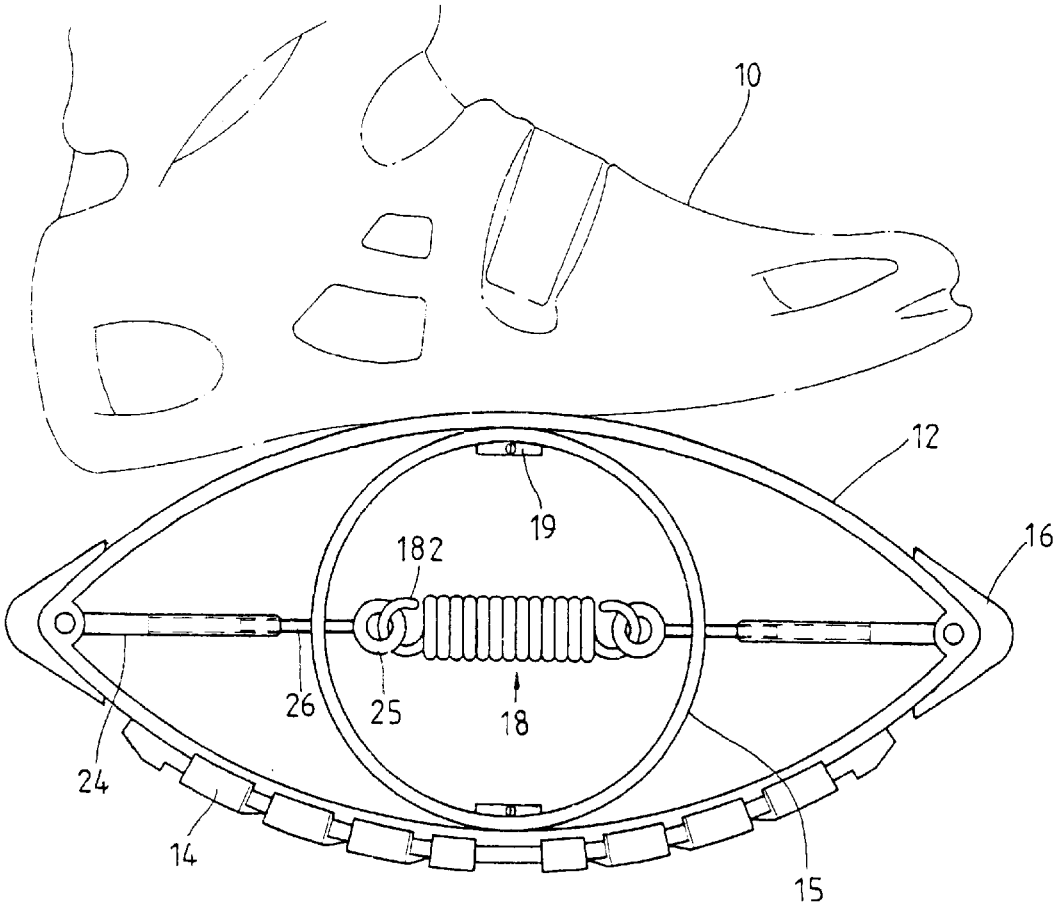
FIG. 3 shows a side schematic view of the present invention.
Figure 4:
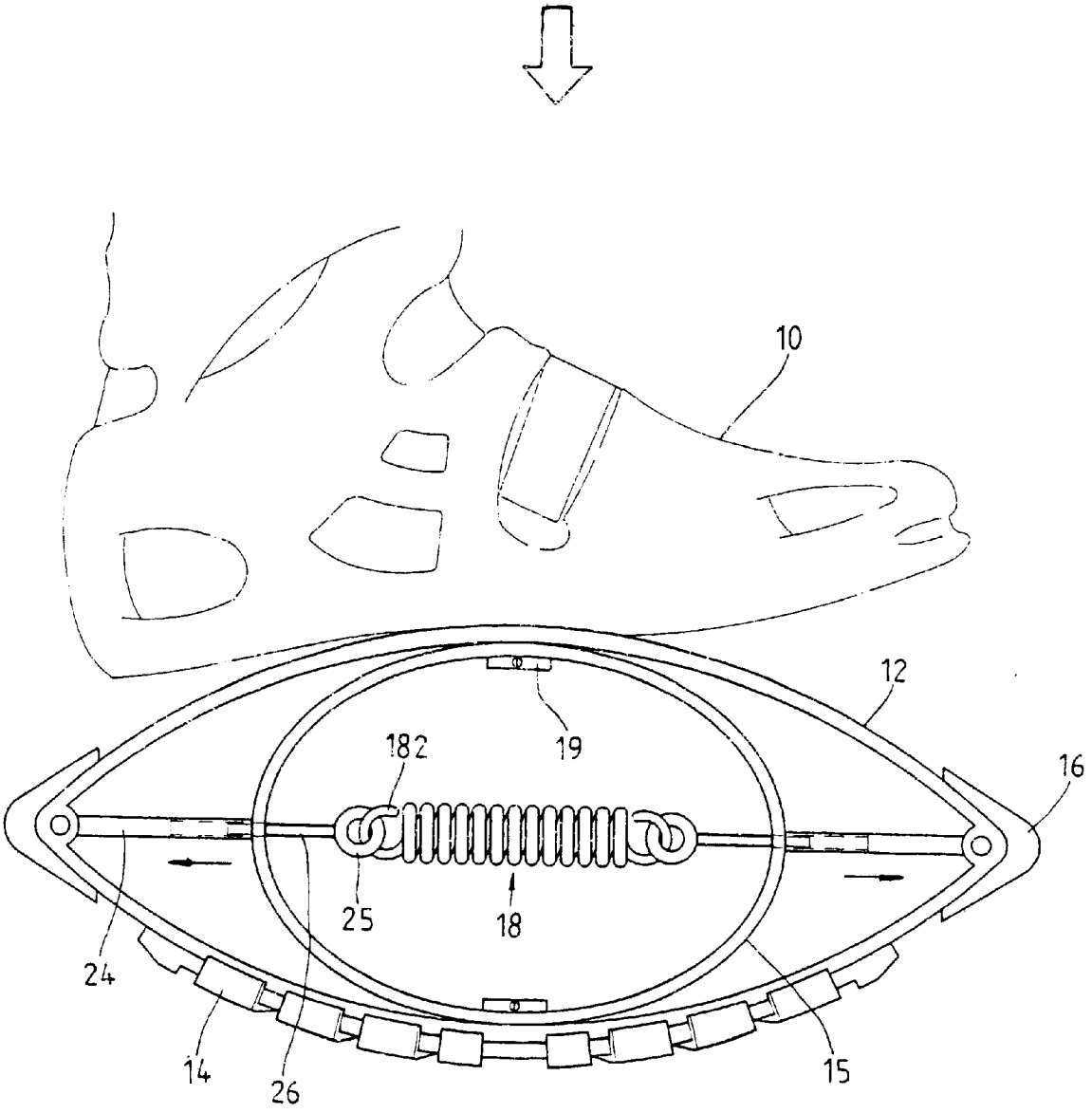
FIG. 4 shows a side schematic view of the present invention in action.

As shown in FIGS. 1 and 2, and exercise shoe embodied in the present invention is composed of an outsole 10 and a frame 12 fastened with the outsole 10.

The outsole 10 is provided with a shoe body fastened therewith for containing the foot of an exercisers Bolts 11 served to attach the frame 12 to the outsole 10.

The frame 12 is provided on the underside with a skidproof piece 14 which is fastened therewith by means of a plurality of screws 13. The frame 12 is further provided respectively at the toe end thereof and the heel end thereof with an elastic protective cover 16, which is fastened thereto by a control rod member 17. The control rod member 17 comprises a bolt 24 having a threaded hole 23, and a pull rod 26 having a retaining ring 25. The pull rod 26 is engaged with the threaded hole 23 of the bolt 24. The frame 12 is further provided respectively in the inner sides of the top and the bottom of the frame 12 with a protuberance 19 engageable with one of the through holes 21 of a circular body 15 which is located inside the frame 12. The circular body 15 is provided coaxially with two engagement holes 22 corresponding in location to the through holes 20 located at the toe end and the heel end of the frame 12.

A spring 18 has a body 181 provided respectively at both ends thereof with a hook 182. The spring 18 is located inside the circular body 15 such that the hooks 182 of the spring 18 are engaged with the retaining rings 25 of the two control rod members 17, which are received in the through holes 20 of the frame 12 and the engagement holes 22 of the circular body 15.

Figure 5:
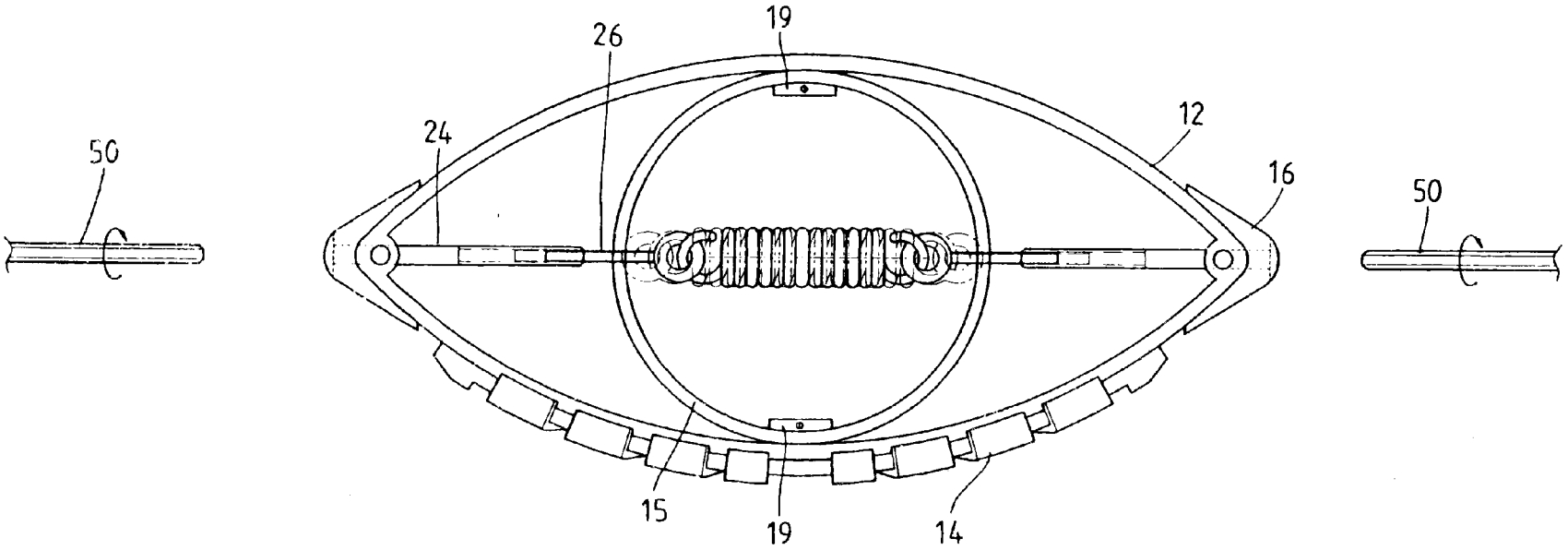
FIG. 5 is a schematic view showing the adjustment of the resilience of the present invention.

As illustrated in FIG. 5, the resilience of the frame 12 can be adjusted by means of a hand tool 50, which is used to rotate the pull rod 26 to turn further into the threaded hole 23 of the bolt 24, thereby resulting in the expansion of the spring 18 and the flattening out of the frame 12. As a result, the frame 12 has a lower resilience. On the other hand, if the pull rod 26 is turned in the direction away from the bottom end of the threaded hole 23 of the bolt 24, the spring 18 is compressed. As a result, the frame 12 has a greater resilience.

Figure 6:
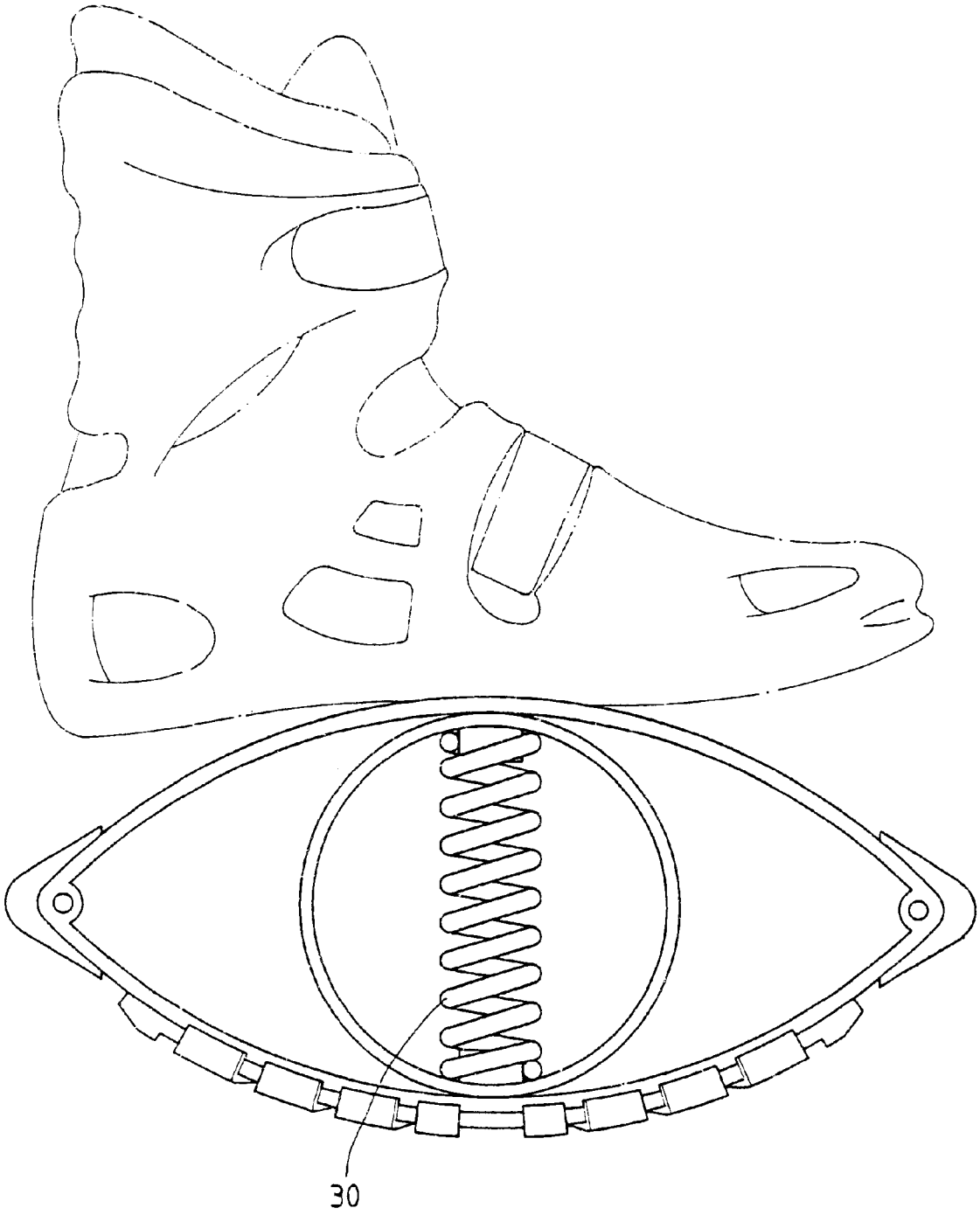
FIG. 6 shows a side schematic view of another preferred embodiment of the present invention.

As shown in FIG. 6, an exercise shoe of another preferred embodiment of the present invention is composed of the frame 12 which is provided with a vertically-oriented spring 30. Both ends of the spring 30 are retained by the protuberances 19 of the frame 12.

The frame 12, the circular body 15 and the skidproof piece 14 of the present invention are made of an elastic and tough material.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise shoe comprising a shoe body having an outsole, and an elastic frame fastened to the outsole; wherein said elastic frame is provided in an underside thereof with a skidproof piece fastened therewith, said elastic frame further provided respectively at a toe end thereof and a heel end thereof with an elastic protective cover fastened therewith by a control rod member, which is engaged with a spring located in an elastic circular body held in said elastic frame.

2. The exercise shoe as defined in claim 1, wherein said frame is provided respectively in inner sides of a top and a bottom thereof with a protuberance; and wherein said circular body is provided with a plurality of through holes engageable with said protuberance.

3. The exercise shoe as defined in claim 1, wherein said frame is provided respectively at the toe end thereof and the heel end thereof with a through hole; wherein said circular body is provided coaxially with two engagement holes corresponding in location to said through holes of said frame; and wherein said control rod member is received in said through hole of said frame and said engagement hole of said circular body.

4. The exercise shoe as defined in claim 1, wherein said control rod member comprises a bolt having a threaded hole, and a pull rod having a retaining ring, said pull rod being engaged with said threaded hole of said bolt; and wherein said spring is provided respectively at both ends thereof with a hook, which is engaged with said retaining ring of said pull rod of said control rod member.

5. The exercise shoe as defined in claim 1, wherein said spring is located in said circular body such that a center line connecting both ends of said spring is parallel to a center line connecting the centers of the toe end and the heel end of said frame.

6. The exercise shoe as defined in claim 1, wherein said spring is located in said circular body such that a center line connecting both ends of said spring is perpendicular to a center line connecting the centers of the toe end and the heel end of said frame.

7. The exercise shoe as defined in claim 6, wherein both ends of said spring are retained by said protuberances of said frame.

* * * * *